US006260679B1

(12) United States Patent
Kuo

(10) Patent No.: US 6,260,679 B1
(45) Date of Patent: Jul. 17, 2001

(54) BEZEL ASSEMBLY FOR WHEELED LUGGAGE

(75) Inventor: Chung-Hsien Kuo, Pan-Chiao (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 09/513,684

(22) Filed: Feb. 25, 2000

(30) Foreign Application Priority Data

Oct. 13, 1999 (TW) ..... 088217364

(51) Int. Cl.[7] ..... A45C 13/26; A45C 13/36
(52) U.S. Cl. ..... 190/115; 190/39
(58) Field of Search ..... 190/39, 115; 16/113.1

(56) References Cited

U.S. PATENT DOCUMENTS 5,482,147 * 1/1996 Wang ..... 190/115
5,533,601 * 7/1996 Wang ..... 190/115
5,566,798 * 10/1996 Tsai ..... 190/115
5,819,891 * 10/1998 Wang ..... 190/115 X
5,875,876 * 3/1999 Wang ..... 190/115 X

* cited by examiner

*Primary Examiner*—Sue A. Weaver
(74) *Attorney, Agent, or Firm*—Dougherty & Troxell

(57) ABSTRACT

A bezel assembly for wheeled luggage on a bezel recess on top of plastic luggage frame. Two spaced apart openings are on the bottom of the bezel recess. Two guiding members are for guiding handle in which each guiding member has a top peripheral flange and an integrally formed sleeve being inserted and detachably attaching to the corresponding opening. This snapping mechanism for securing guiding member and bezel thus simplifies the structure of bezel assembly and facilitating the assembly.

6 Claims, 4 Drawing Sheets

BEZEL ASSEMBLY FOR WHEELED LUGGAGE

BACKGROUND OF THE INVENTION

1. Field of the Invention

The present invention relates to a luggage and more particularly to a bezel assembly or a wheeled luggage in which a bezel recess is integrally formed with a frame having guiding members for guiding and securing handle therein.

2. Description of Related Art

Conventionally, a bezel is an important element of a handle for wheeled luggage. The assembly of bezel into a luggage frame is as follows. First, fixedly attaches a top plate to the top frame of luggage. Then, fixedly attaches bezel to the top plate. Finally, mount support tubes in the bezel. In view of the foregoing, such assembly is time consuming. Further simplification of components is thus desirable.

Furthermore, a typical luggage is a parallelpiped body with molded frame wherein a top plate and a bottom plate are provided on top and bottom panels respectively for providing a sufficient support for the fabric covered thereon. It is found that the longitudinal strength of luggage is weak, while the lateral strength of luggage is further weak. In other words, such typical luggage is not resistant to impact and thus handle with care must be obeyed for prolong its life cycle.

As a result, such luggage is usually carried or towed by traveler for preventing from accidental impact. Such structural weakness is disadvantageous.

Thus, it is desirable to provide an improved bezel for wheeled luggage in order to overcome the above drawbacks of prior art.

SUMMARY OF THE INVENTION

It is an object of the present invention to provide an integrally formed bezel assembly for wheeled luggage having guiding members for guiding and securing a handle therein.

It is another object of the present invention to provide a bezel assembly for wheeled luggage wherein guiding members are secured by means of a snapping mechanism, thus simplifying the structure of the bezel assembly and facilitating the assembly.

To achieve the above and other objects, the present invention comprises a bezel recess integrally formed on a top of a plastic luggage frame, two spaced apart openings on the bottom of the bezel recess, and two flexible guiding members for guiding handle wherein each of the guiding members has a top peripheral flange and an integrally formed sleeve being inserted and detachably attaching to the corresponding opening.

The above and other objects, features and advantages of the present invention will become apparent from the following detailed description taken with the accompanying drawings.

DETAILED DESCRIPTION OF THE PREFERRED EMBODIMENTS

Figure 2:
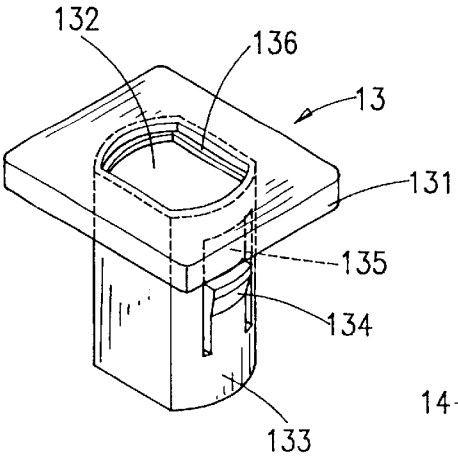
FIG. 2 is an enlarged perspective view of the guiding member shown in FIG. 1.
Figure 1:
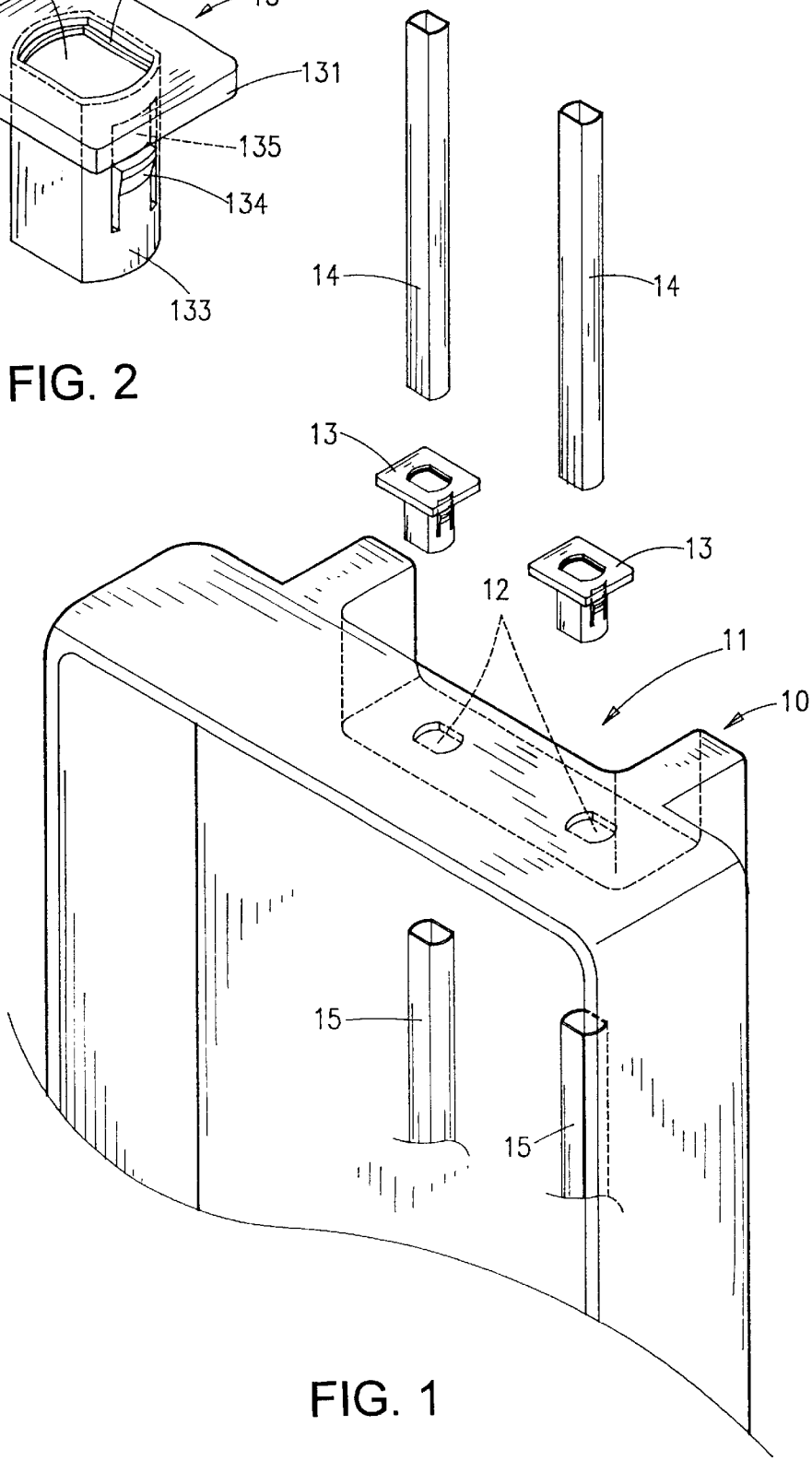
FIG. 1 is an exploded view of a first embodiment of a bezel assembly for wheeled luggage according to the invention.
Figure 3:
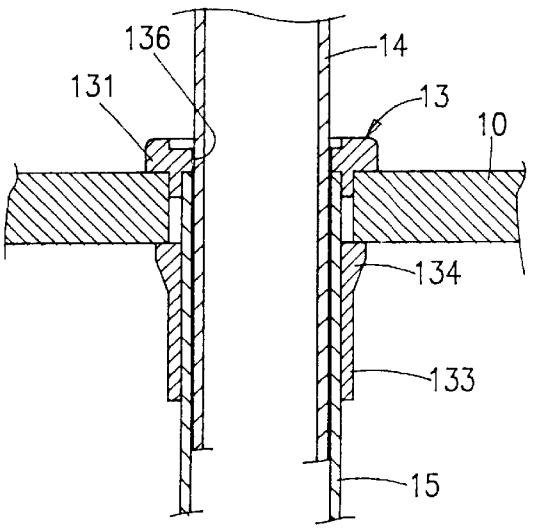
FIG. 3 is a partial sectional view of FIG. 1 showing the assembled bezel assembly.

Referring to FIGS. 1–3, there is shown a first embodiment of a bezel assembly for wheeled luggage constructed in accordance with the invention comprising a bezel recess 11 on top of plastic frame 10, two spaced apart openings 12 on the bottom of the bezel recess 11, and two guiding members 13 for guiding handle wherein each of the guiding members 13 has a top peripheral flange 131 and an integrally formed sleeve 133. The guiding member 13 further has a bore 132 for allowing handle to pass through, a latched member 134 provided on a side, a cavity 135 formed between peripheral flange 131 and latched member 134, and an inner top peripheral flange 136. The longitudinal length of cavity 135 conforms to the thickness of plastic frame 10 such that frame 10 and guiding member 13 are secured together when guiding member 13 is inserted in the opening 12 with a portion of frame 10 received in the cavity 135 and sandwiched between latched member 134 and top peripheral flange 131 (see FIG. 3).

The inner diameter of inner top peripheral flange 136 conforms to the outer diameter of sliding tube 14 for allowing sliding tube 14 to slidingly move therein. The diameter of bore 132 below the peripheral flange 136 conforms to the outer diameter of support tube 15. In assembly, support tube 15 is inserted from the bottom of guiding member 13 through the bore 132 until comes into contact with bottom of peripheral flange 136. For further enhancing the engagement between support tube 15 and guiding member 13, the lower portion of support tube 15 is further fixed at a bottom plate (not shown). As a result, the guiding member 13 is secured to opening 12 on the bottom of the bezel recess 11 of frame 10 without employing any known fastener such as thread or rivet. In brief, guiding members 13 are secured by means of a snapping mechanism, thus simplifying the structure of bezel assembly and facilitating the assembly.

Figure 6:
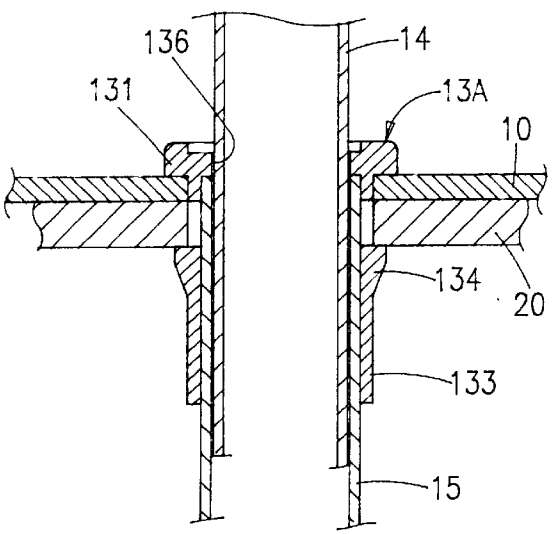
FIG. 6 is a partial sectional view of FIG. 4 showing the assembled bezel assembly.
Figure 5:
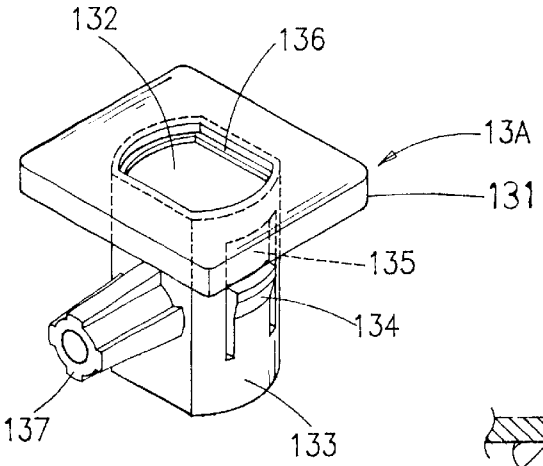
FIG. 5 is an enlarged perspective view of the guiding member shown in FIG. 4.
Figure 4:
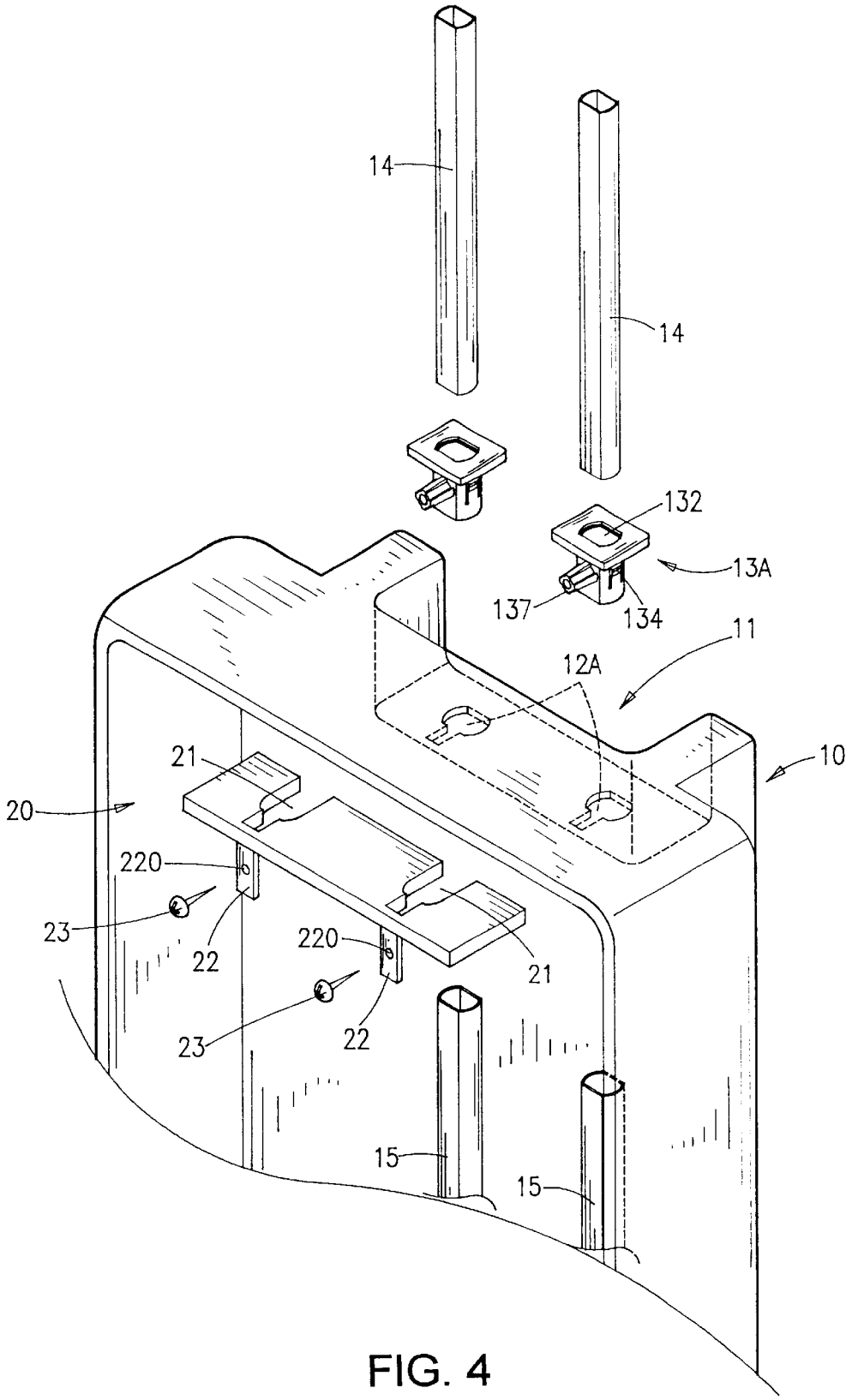
FIG. 4 is an exploded view of a second embodiment of a bezel assembly for wheeled luggage according to the invention.

FIGS. 4–6 illustrate a second embodiment of a bezel assembly for wheeled luggage suitable to a relatively weak frame structure. Second embodiment is generally the same in configuration with first embodiment with a few exceptions as detailed below. For enhancing the bottom of the bezel recess, an additional support plate 20 is provided below the bezel recess 11 sandwiched between latched member 134 and frame 10. The length of support plate 20 is equal to or smaller than that of the bezel recess 11. A horizontal hollow member 137 is protruded from a side of guiding member 13A. Two vertical members 22 each corresponding to the protruded member 137 are integrally formed on the bottom of support plate 20. A hole 220 is provided on the member 22.

For ease of assembly, each opening 12A is shaped like a key corresponding to the guiding member 13A with protruded member 137 (see FIG. 4). Similarly, two key-shaped openings 21 are formed on the support plate 20 each corresponding to the guiding member 13A. As such, guiding member 13A may insert into opening 12A and opening 21 with the member 137 aligned with hole 220 when guiding member 13A is secured in bezel. Further, thread a screw 23 through the hole 220 and member 137 in order to secure support plate 20 and guiding member 13A together on the bezel (FIG. 6).

Figure 7:
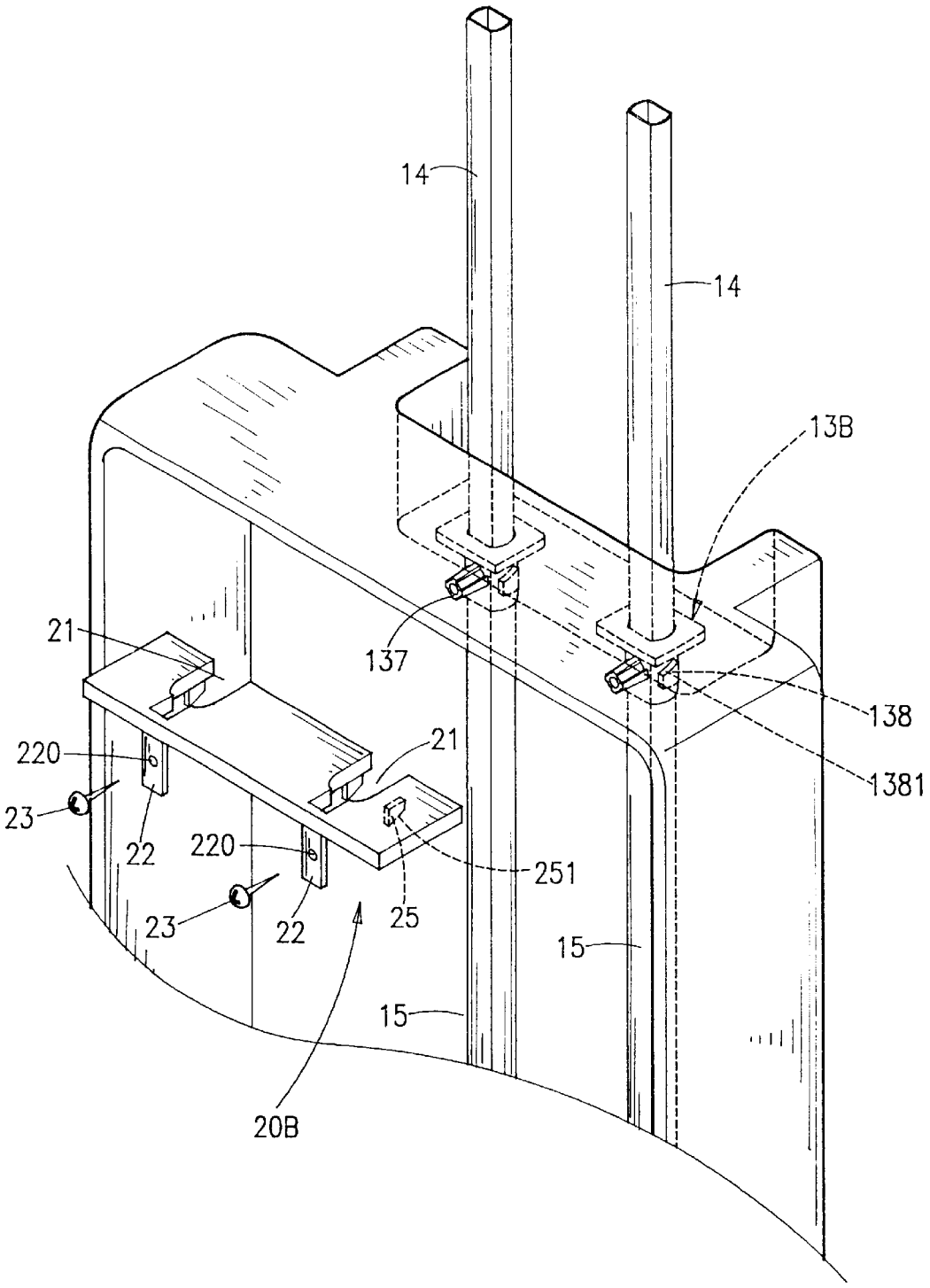
FIG. 7 is an exploded view of a third embodiment of a bezel assembly for wheeled luggage according to the invention.

FIG. 7 illustrates a third embodiment of a bezel assembly for wheeled luggage. Third embodiment is generally the same in configuration with second embodiment with the exception of employing a pair of snapping members 138 of guiding members 13B in replacement of the latched members 134 of first and second embodiments. Correspondingly, a pair of mating snapping members 25 are provided on the bottom surface of support plate 20B. In assembly, a downward (or an upward) slope 251 of snapping member 25 is engaged with a corresponding upward (or a downward) slope 1381 of snapping member 138 when support plate 20B inserts into the bottom of bezel recess 11. Further, thread a screw 23 through the hole 220 and member 137 in order to secure support plate 20B and guiding member 13B together on the bezel.

While the invention herein disclosed has been described by means of specific embodiments, numerous modifications and variations could be made thereto by those skilled in the art without departing from the scope of the invention set forth in the claims.

What is claimed is:

1. A bezel assembly for wheeled luggage comprising:

a plastic frame having a bezel recess on a top;

a handle having a pair of sliding tubes and a pair of support tubes;

a pair of spaced apart openings provided on a bottom of the bezel recess; and a pair of guiding members for guiding the handle wherein each of the pair of guiding members has a top peripheral flange and an integrally formed sleeve and is inserted into one of the pair of spaced apart openings so as to detachably attach the guiding members to a bottom of the recess.

2. The bezel assembly for wheeled luggage of claim 1, wherein each of the guiding members comprises a latched member on a side for sandwiching the frame between the latched member and the top peripheral flange.

3. The bezel assembly for wheeled luggage of claim 1, wherein the sleeve comprises an inner top peripheral flange allowing each of the sliding tubes to slidingly move therein and securing the top of each of the support tubes to a bottom of the inner top peripheral flange.

4. The bezel assembly for wheeled luggage of claim 1, further comprising a support plate having two vertical members integrally formed thereon.

5. The bezel assembly for wheeled luggage of claim 4, wherein the sleeve comprises a horizontal hollow member protruding therefrom and secured to one of the vertical members of the support plate.

6. The bezel assembly for wheeled luggage of claim 4, wherein the guiding members each comprise a pair of first snapping members each having a first slope and the support plate comprises a pair of mating second snapping members each having a second slope such that the first slope of each of the first snapping members is engaged with the corresponding second slope of each of the second snapping members for securing the support plate to a bottom of said bezel recess.

* * * * *